US011028335B2

(12) United States Patent
Shishikura et al.

(10) Patent No.: US 11,028,335 B2
(45) Date of Patent: Jun. 8, 2021

(54) GREASE COMPOSITION, METHOD FOR MANUFACTURING GREASE COMPOSITION, AND METHOD FOR USING GREASE COMPOSITION

(71) Applicant: IDEMITSU KOSAN CO., LTD., Chiyoda-ku (JP)

(72) Inventors: Akihiro Shishikura, Chiba (JP); Tomonobu Takada, Chiba (JP); Hiroki Sekiguchi, Ichihara (JP); Asami Koga, Chiba (JP); Go Watanabe, Chiba (JP); Harutomo Ikeda, Ichihara (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/469,302

(22) PCT Filed: Jan. 17, 2018

(86) PCT No.: PCT/JP2018/001244
§ 371 (c)(1),
(2) Date: Jun. 13, 2019

(87) PCT Pub. No.: WO2018/135537
PCT Pub. Date: Jul. 26, 2018

(65) Prior Publication Data

US 2019/0300814 A1 Oct. 3, 2019

(30) Foreign Application Priority Data

Jan. 18, 2017 (JP) ..... JP2017-006937

(51) Int. Cl.

| | |
|---|---|
| ***C10M 169/00*** | (2006.01) |
| ***C10M 101/02*** | (2006.01) |
| ***C10M 117/02*** | (2006.01) |
| ***C10M 117/06*** | (2006.01) |
| ***C10M 125/10*** | (2006.01) |
| ***C10M 129/08*** | (2006.01) |
| ***C10M 133/42*** | (2006.01) |
| ***C10M 141/06*** | (2006.01) |
| ***C10M 135/06*** | (2006.01) |
| *C10N 20/02* | (2006.01) |
| *C10N 30/00* | (2006.01) |
| *C10N 50/10* | (2006.01) |

(52) U.S. Cl.

CPC ..... *C10M 169/00* (2013.01); *C10M 101/02* (2013.01); *C10M 117/02* (2013.01); *C10M 117/06* (2013.01); *C10M 125/10* (2013.01); *C10M 129/08* (2013.01); *C10M 133/42* (2013.01); *C10M 135/06* (2013.01); *C10M 141/06* (2013.01); *C10M 2201/062* (2013.01); *C10M 2203/1025* (2013.01); *C10M 2207/022* (2013.01); *C10M 2207/1236* (2013.01); *C10M 2207/1265* (2013.01); *C10M 2215/30* (2013.01); *C10N 2020/02* (2013.01); *C10N 2030/43* (2020.05); *C10N 2030/50* (2020.05); *C10N 2050/10* (2013.01)

(58) Field of Classification Search

CPC ..... C10M 169/00; C10N 2030/50; C10N 2050/10

See application file for complete search history.

(56) References Cited

U.S. PATENT DOCUMENTS

| | | | | |
|---|---|---|---|---|
| 5,096,605 | A * | 3/1992 | Waynick | C10M 169/00 508/163 |
| 5,370,808 | A | 12/1994 | Onishi et al. | |
| 5,472,626 | A | 12/1995 | Musilli | |
| 2011/0041638 | A1* | 2/2011 | Fujinami | C10M 169/02 74/424.81 |
| 2011/0048809 | A1* | 3/2011 | Duckworth | E21B 10/18 175/331 |
| 2011/0059879 | A1* | 3/2011 | Barnes | C10M 177/00 508/306 |
| 2011/0082060 | A1* | 4/2011 | Faci | C10M 169/06 508/161 |

(Continued)

FOREIGN PATENT DOCUMENTS

| | | | |
|---|---|---|---|
| JP | 2-196894 | A | 8/1990 |
| JP | 8-143885 | A | 6/1996 |

(Continued)

OTHER PUBLICATIONS

International Search Report dated Feb. 27, 2018, in PCT/JP2018/001244 filed on Jan. 17, 2018.

Indian Office Action dated Nov. 20, 2020 in Indian Patent Application No. 201947028585, 6 pages.

Office Action dated Sep. 29, 2020 in corresponding Japanese Patent Application No. 2017-006937 (with English Translation), 7 pages.

*Primary Examiner* — Ellen M McAvoy

(74) *Attorney, Agent, or Firm* — Oblon, McClelland, Maier & Neustadt, L.L.P.

(57) ABSTRACT

Provided is a grease composition which is excellent in fire extinguishing performance without water and can suppress fuming, malodor, and liquefaction on burning and a method for producing the grease composition.

A grease composition contains a base oil (A), a thickener (B), and a fire retardant (C), wherein the base oil (A) contains a base oil (A1) having a 40° C. kinematic viscosity of 300 $mm^2/s$ or more, a sulfur content of 20 ppm by mass or less, and an initial boiling point of 400° C. or higher, the fire retardant (C) is at least one of aluminum hydroxide (C1) and 1,3,5-triazine-1,3,5 (2H, 4H, 6H)-tris(ethanol) (C2), and a content of the fire retardant (C) is 1.0 to 12.0 mass % based on a total amount of the grease composition.

12 Claims, No Drawings

(56) References Cited

U.S. PATENT DOCUMENTS

| | | | | |
|---|---|---|---|---|
| 2012/0119137 | A1* | 5/2012 | Tsuji | C08L 83/04 252/78.3 |
| 2012/0231986 | A1 | 9/2012 | Smithers et al. | |
| 2012/0280169 | A1* | 11/2012 | Kato | C10M 169/02 252/75 |
| 2012/0329695 | A1* | 12/2012 | Beret | C10M 169/00 508/506 |
| 2013/0137613 | A1* | 5/2013 | Kato | C10M 155/02 508/172 |
| 2015/0097138 | A1* | 4/2015 | Kato | C08K 3/22 252/75 |
| 2017/0362527 | A1* | 12/2017 | Fiddelaers | C10M 123/02 |
| 2017/0362531 | A1* | 12/2017 | Fiddelaers | C10M 133/16 |

FOREIGN PATENT DOCUMENTS

| | | | |
|---|---|---|---|
| JP | 8-199183 | A | 8/1996 |
| JP | 2007-217521 | A | 8/2007 |
| JP | 2008-274091 | A | 11/2008 |
| JP | 2011-105828 | A | 6/2011 |
| JP | 2011-522109 | A | 7/2011 |
| JP | 2012-102235 | A | 5/2012 |
| JP | 2013-510212 | A | 3/2013 |
| JP | 2013-103966 | A | 5/2013 |
| JP | 2013-189498 | A | 9/2013 |
| WO | WO 2016/066799 | A1 | 5/2016 |

* cited by examiner

GREASE COMPOSITION, METHOD FOR MANUFACTURING GREASE COMPOSITION, AND METHOD FOR USING GREASE COMPOSITION

TECHNICAL FIELD

The present invention relates to a grease composition, a method for producing the grease composition, and a method for using the grease composition.

BACKGROUND ART

In various equipment and machines, grease may be used for improving lubricity of a lubrication portion such as a bearing, a sliding portion, and a joint portion.

A use environment of the grease varies greatly depending on uses. For example, since steel manufacturing equipment and forging equipment are exposed to a high temperature, the grease may drip down and accumulate. When a high temperature manufactured product or a scale scatters onto the accumulated grease, the grease ignites and causes a fire, which is viewed as a problem. The scale is a kind of iron oxide generated when iron is heated to a high temperature.

In addition, when the grease accumulates in a narrow place where a person's hand cannot reach, there is a problem that it is difficult to remove the grease at any time.

Further, there is also a problem that it becomes difficult to discover a fire early along with automation of equipment in recent years.

Therefore, there is a demand for a lubricating grease composition excellent in fire extinguishing performance that prevents spread of the fire. For example, techniques of PTLs 1 to 2 are proposed for greases for the purpose of improving fire extinguishing performance.

CITATION LIST

Patent Literature

PTL 1: JP 2011-105828 A
PTL 2: JP 8-199183 A

SUMMARY OF INVENTION

Technical Problem

PTL 1 discloses a grease composition containing a sulfurized olefin, and discloses that in a grease burning test, the grease composition ignites after a steel ball heated to 950° C. is put in, and then extinguishes fire (burning time: 125 to 200 seconds).

However, the grease composition of PTL 1 has a risk of burning over a long time after ignition, and when the grease composition is burned, there is a problem that the grease composition liquefied by burning scatters around and contaminates the surrounding environment while black smoke and malodor are generated.

PTL 2 discloses a grease composition in which 30 to 100 parts by weight of water, 0.5 to 100 parts by weight of an emulsifier, and 40 to 300 parts by weight of aluminum hydroxide are blended with respect to 100 parts by weight of a base oil.

However, since the grease composition of PTL 2 is an emulsion-based grease composition containing water, there is a problem that rust occurs in equipment and machines clue to an influence of water.

The present invention has been made to solve the above problems, and an object of the present invention is to provide a grease composition which is excellent in fire extinguishing performance without water and can suppress fuming, malodor, and liquefaction on burning, a method for producing the grease composition, and a method for using the grease composition.

Solution to Problem

The present invention provides a grease composition, a method for producing the grease composition, and a method for using the grease composition of the following [1] to [3].

[1] A grease composition containing base oil (A), a thickener (B), and a fire retardant (C), wherein the base oil (A) contains a base oil (A1) having a 40° C. kinematic viscosity of 300 $mm^2/s$ or more, a sulfur content of 20 ppm by mass or less, and an initial boiling point of 400° C. or higher, the fire retardant (C) is at least one of aluminum hydroxide (C1) and 1,3,5-triazine-1,3,5 (2H, 4H, 6H)-tris(ethanol) (C2), and a content of the fire retardant (C) is from 1.0 to 12.0 mass % based on a total amount of the grease composition.

[2] A method for producing a grease composition, including the following steps (1) and (2):

(1) a step of mixing a base oil (A) containing a base oil (A1) having a 40° C. kinematic viscosity of 300 $mm^2/s$ or more, a sulfur content of 20 ppm by mass or less, and an initial boiling point of 400° C. or higher with a thickener (B) to form a grease; and (2) a step of mixing the grease with at least one of aluminum hydroxide (C1) and 1,3,5-triazine-1,3,5 (2H, 4H, 6H)-tris(ethanol) (C2) as a fire retardant (C) after the step (1) to obtain a grease composition in which a content of the fire retardant (C) is from 1.0 to 12.0 mass % based on a total amount of the grease composition.

[3] Use of the grease composition according to the above [1] as a grease composition for steel manufacturing equipment, forging equipment, or a heat treatment apparatus.

Advantageous Effects of Invention

The grease composition of the present invention is excellent in fire extinguishing performance without water and can suppress fuming, malodor, and liquefaction on burning. In the method for producing the grease composition of the present invention, the grease composition exhibiting the above effects can be easily produced.

DESCRIPTION OF EMBODIMENTS

[Grease Composition]

A grease composition of the present embodiment contains a base oil (A), a thickener (B), and a fire retardant (C), wherein the base oil (A) contains a base oil (A1) having a 40° C. kinematic viscosity of 300 $mm^2/s$ or more, a sulfur content of 20 ppm by mass or less, and an initial boiling point of 400° C. or higher, the fire retardant (C) is at least one of aluminum hydroxide (C1) and 1,3,5-triazine-1,3,5 (2H, 4H, 6H)-tris(ethanol) (C2), and a content of the fire retardant (C) is 1.0 to 12.0 mass % based on a total amount of the grease composition.

<Base Oil (A)>

The base oil (A) contains a base oil (A1) having a 40° C. kinematic viscosity of 300 $mm^2/s$ or more, a sulfur content of 20 ppm by mass or less, and an initial boiling point of 400° C. or higher.

When the 40° C. kinematic viscosity of the base oil (A1) is less than 300 $mm^2/s$, the grease composition is easily burned and the fire extinguishing performance is insufficient. When the sulfur content of the base oil (A1) is more than 20 ppm by mass, fuming and black smoke on burning cannot be suppressed. When the initial boiling point of the base oil (A1) is less than 400° C., the fire extinguishing performance is insufficient.

In the present specification, the "fire extinguishing performance" refers to performance of extinguishing fire in a short time without taking an operation for extinguishing fire.

When the 40° C. kinematic viscosity of the base oil (A1) is too large, the flowability tends to deteriorate. The 40° C. kinematic viscosity of the base oil (A1) is preferably 300 to 1,000 $mm^2/s$, more preferably 350 to 800 $mm^2/s$, and further preferably 350 to 600 $mm^2/s$ in view of balance of improvement of fire extinguishing performance and flowability.

In the present embodiment, the 40° C. kinematic viscosity and a viscosity index show values measured according to JIS K2283: 2000.

The sulfur content of the base oil (A1) is preferably 10 ppm by mass or less, more preferably 5 ppm by mass or less, and further preferably 3 ppm by mass or less.

In the present embodiment, the sulfur content of the base oil shows a value measured according to an ultraviolet fluorescence method of JIS K2541-6.

When the initial boiling point of the base oil (A1) is too large, the flowability tends to deteriorate. The initial boiling point of the base oil (A1) is preferably 400° C. to 600° C., more preferably 420° C. to 550° C., and further preferably 430° C. to 500° C. in view of balance of fire extinguishing performance and flowability.

In the present embodiment, the initial boiling point shows a value measured under conditions of a pressure of 133 Pa according to a reduced-pressure method of JIS K2254.

The base oil (A1) is not particularly limited as long as it has a 40° C. kinematic viscosity, a sulfur content, and an initial boiling point within the above ranges, and one or more selected from a mineral oil and/or a synthetic oil can be used.

Examples of the mineral oil of the base oil (A1) include a bright stock.

The bright stock refers to a high viscosity base oil produced through a treatment selected from solvent deasphalting, solvent extraction, solvent dewaxing, and hydrofining on a reduced-pressure distillation residue oil of a crude oil. The crude oil for producing the bright stock can be used without a particular limit, and examples thereof include a paraffinic crude oil and a naphthenic crude oil.

Examples of the bright stock used in the present embodiment include a bright stock (A1-a) obtained through hydrofining and a bright stock (A1-b) obtained through solvent refining.

Examples of the bright stock (A1-a) include those obtained by hydrofining the reduced-pressure distillation residue oil of the crude oil. In addition to the hydrofining treatment, the bright stock (A1-a) may be produced by appropriately combining conventionally known refining processes such as dewaxing and deasphalting.

Here, the hydrofining treatment refers to a hydrofining treatment under relatively severe conditions under which (1) an opening ring and dealkylation of a side chain of a polycyclic compound due to hydrogenolysis, (2) isomerization, (3) removal of a hetero atom from a hydrocarbon containing the hetero atom, or the like occurs.

Examples of the bright stock (A1-b) include those obtained by subjecting the reduced-pressure distillation residue oil of the crude oil to a solvent extraction treatment. In addition to the solvent extraction treatment, the bright stock (A1-b) may be produced by appropriately combining conventionally known refining processes such as a dewaxing treatment, a deasphalting treatment, and hydrofinishing.

Here, the hydrofinishing is performed generally by performing a hydrogenation treatment at a relatively low pressure for the purpose of improving hue and the like, and is different from the hydrofining treatment.

The mineral oil of the base oil (A1) of the present embodiment is preferably the bright stock (A1-a) obtained through hydrofining in view of producing a base oil having a 40° C. kinematic viscosity of $mm^2/s$ or more, a sulfur content of 20 ppm by mass or less, and an initial boiling point of 400° C. or higher. The bright stock (A1-a) obtained through the hydrofining is also effective even in terms of raising a flash point.

Examples of the synthetic oil of the base oil (A1) include a hydrocarbon-based synthetic oil and an ether-based synthetic oil. Examples of the hydrocarbon-based synthetic oil include an α-olefin oligomer such as polybutene, polyisobutylene, a 1-octene oligomer, a 1-decene oligomer, and an ethylene-propylene copolymer, or a hydrogenated product thereof, an alkylbenzene, and an alkylnaphthalene. Examples of the ether-based synthetic oil include a polyoxy alkylene glycol and a polyphenyl ether.

The base oil (A1) preferably has a viscosity index of 80 or more, more preferably 90 or more, and further preferably 100 or more. By setting the viscosity index of the base oil (A1) to 80 or more, lubricity can be maintained in a wide range of temperature.

The base oil (A1) preferably has a flash point of 200° C. or higher, more preferably 250° C. or higher, and further preferably 270° C. or higher in view of flame retardancy.

In the present embodiment, the flash point shows a value measured according to a Cleveland open-cup method of JIS K2265-4: 2007.

The base oil (A) may contain a base oil other than the base oil (A1) described above.

From the viewpoint of making it easy to express effects of the present embodiment, the base oil (A1) is contained in preferably 80 mass % or more, more preferably 90 mass % or more, further preferably 95 mass % or more, and most preferably 100 mass % based on a total amount of the base oil (A).

A content of the base oil (A) in the grease composition is preferably 50 to 98 mass %, more preferably 60 to 95 mass %, and further preferably 70 to 90 mass % based on a total amount of the grease composition from the viewpoint of making it easy to express the effects of the present embodiment.

<Thickener (B)>

As the thickener (B), one or more kinds selected from a non-soap-based thickener such as a urea-based thickener, a fluorine resin-based thickener, and a carbon-based thickener, a soap-based thickener, and the like can be used. Among them, the soap-based thickener is preferable in view of flame retardancy.

Examples of the soap-based thickener include a single soap such as a lithium soap, a calcium soap, and an aluminum soap, and a complex soap such as a lithium complex soap, a calcium complex soap, and an aluminum complex soap. Among them, the lithium soap and the lithium complex soap are suitable in view of water resistance and heat resistance.

The soap-based thickener can be obtained, for example, by saponifying a carboxylic acid or an ester thereof with a metal hydroxide as raw materials.

The soap-based thickener may be saponified in the base oil (A) by adding a carboxylic acid or an ester thereof and a metal hydroxide to the base oil (A).

Examples of metal constituting the metal hydroxide include sodium, calcium, lithium, and aluminum.

Examples of the carboxylic acid include a crude fatty acid obtained by hydrolyzing fats or fatty oils and removing glycerin, a monocarboxylic acid such as stearic acid, a monohydroxy carboxylic acid such as 12-hydroxy stearic acid, a dibasic acid such as azelaic acid, and an aromatic carboxylic acid such as terephthalic acid, salicylic acid, and benzoic acid. These may be used in one kind alone or in combination of two or more kinds thereof.

In the present specification, the complex soap refers to a soap obtained by using a fatty acid such as stearic acid, oleic acid, and palmitic acid and/or a hydroxy fatty acid having 12 to 24 carbon atoms and one or more hydroxy groups in the molecule (carboxylic acid A), and an aromatic carboxylic acid and/or an aliphatic dicarboxylic acid having 2 to 12 carbon atoms (carboxylic acid B) in combination as a carboxylic acid.

The soap-based thickener is preferably a single soap or a complex soap containing a hydroxy carboxylic acid having 12 to 24 carbon atoms, more preferably a single soap or a complex soap containing a hydroxy carboxylic acid having 16 to 20 carbon atoms, and further preferably a single soap or a complex soap containing 12-hydroxy stearic acid as a raw material carboxylic acid.

In a case of the complex soap, it is preferable to use an aromatic carboxylic acid and/or an aliphatic dicarboxylic acid having 2 to 12 carbon atoms in addition to the hydroxy carboxylic acid having 12 to 24 carbon atoms as the raw material carboxylic acid.

Examples of the aromatic carboxylic acid include benzoic acid, phthalic acid, isophthalic acid, terephthalic acid, trimellitic acid, pyromellitic acid, salicylic acid, and p-hydroxybenzoic acid.

Examples of the aliphatic dicarboxylic acid having 2 to 12 carbon atoms include azelaic acid, sebacic acid, oxalic acid, malonic acid, succinic acid, adipic acid, pimelic acid, suberic acid, undecanedioic acid, and dodecanedioic acid.

Among the exemplified aromatic carboxylic acid and/or the aliphatic dicarboxylic acid having 2 to 12 carbon atoms, azelaic acid is suitable.

A content of the soap-based thickener is preferably 80 mass % or more, more preferably 90 mass % or more, further preferably 95 mass % or more, and most preferably 100 mass % based on a total amount of the thickener (B).

A content of the thickener (B) in the grease composition is preferably 1 to 10 mass %, more preferably 1 to 8 mass %, and further preferably 2 to 7 mass % based on a total amount of the grease composition.

By setting the content of the thickener (B) to the above range, lubricity and handleability of the grease composition can be easily improved.

<Fire Retardant (C)>

The grease composition of the present embodiment further contains at least one fire retardant (C) selected from aluminum hydroxide (C1) and 1,3,5-triazine-1,3,5 (2H, 4H, 6H)-tris(ethanol) (C2).

Since at least one fire retardant (C) selected from aluminum hydroxide (C1) and 1,3,5-triazine-1,3,5 (2H, 4H, 6H)-tris(ethanol) (C2) is contained, it is possible to provide a grease composition that puts out fire in a short time without performing an operation for extinguishing fire in a case of ignition, and the fire extinguishing performance is thus improved. Therefore, even when the grease composition ignites, the grease composition of the present embodiment can suppress the occurrence of fire.

In addition, since the grease composition of the present embodiment contains at least one of the above (C1) and (C2) and has an excellent fire extinguishing performance, it is possible to suppress fuming, malodor, and liquefaction of the grease composition, which originate in burning.

Further, the above (C1) and (C2) do not contain sulfur which is a main cause of the malodor. Therefore, the grease composition of the present embodiment is extremely excellent in suppressing malodor originating in burning.

The grease composition of the present embodiment contains 1.0 to 12.0 mass % of the fire retardant (C) based on a total amount of the grease composition.

When the content of the fire retardant (C) is less than 1.0 mass % based on the total amount of the grease composition, the fire extinguishing performance of the grease composition is insufficient, and a fire cannot be suppressed.

When the content of the fire retardant (C) exceeds 12.0 mass % based on the total amount of the grease composition, the fire extinguishing performance corresponding to the content of the fire retardant (C) cannot be expected and the content of the base oil (A) and the content of the thickener (B) are relatively reduced, so that lubricity is reduced. When the content of the aluminum hydroxide (C1) exceeds 12.0 mass % based on the total amount of the grease composition, the lubricity becomes too insufficient and abrasion of a lubrication portion becomes intense, while flowability of the grease composition is reduced and a pipe is easily clogged. In addition, when the content of 1,3,5-triazine-1,3,5 (2H, 4H, 6H)-tris(ethanol) (C2) exceeds 12.0 mass % based on the total amount of the grease composition, lubricity is reduced and an amount of a nitrogen compound generated on burning increases with an increase of an amount of (C2), and a malodor originating in the nitrogen compound becomes a problem.

The content of the fire retardant (C) is preferably 2.0 to 11.0 mass %, more preferably 3.0 to 10.5 mass %, and further preferably 4.0 to 10.0 mass % based on the total amount of the grease composition.

The content of the fire retardant (C) means the content of the (C1) alone when the fire retardant (C) only contains the (C1), means the content of the (C2) alone when the fire retardant (C) only contains the (C2), and means a sum of the content of the (C1) and the (C2) when the fire retardant (C) contains the (C1) and the (C2).

An average particle diameter of the aluminum hydroxide (C1) is preferably 5.0 μm or less, more preferably 3.0 μm or less, and further preferably 2.0 μm or less. By setting the average particle diameter of the aluminum hydroxide (C1) to 5.0 μm or less, the fire extinguishing performance and the flowability of the grease composition can be improved. A lower limit of the average particle diameter of the aluminum hydroxide (C1) is not particularly limited, but is generally about 0.01 μm.

In the present specification, the average particle diameter is a 50% particle diameter (d50: median diameter) in the case where aluminum hydroxide particles dispersed in a solution are measured by a dynamic light scattering method and a particle diameter distribution is expressed by a cumulative distribution in terms of volume.

<Fire Retardant Promotor (D)>

The grease composition of the present embodiment may further contain a fire retardant promotor (D).

Examples of the fire retardant promotor (D) include one or more kinds selected from zinc carbonate (D1), polyhydric alcohol (D2), sulfurized fats or fatty oils (D3), and melamine cyanurate, and one or more kinds selected from zinc carbonate (D1), polyhydric alcohol (D2), and sulfurized fats or fatty oils (D3) are preferable.

The zinc carbonate (D1) is an abbreviation of basic zinc carbonate and is a compound represented by a chemical formula $2\ ZnCO_3.3\ Zn(OH)_2.H_2O$.

Examples of the polyhydric alcohol (D2) include glycerin, trimethylolethane, trimethylolpropane, and pentaerythritol. Among them, glycerin is preferable.

Examples of the sulfurized fats or fatty oils (D3) include those obtained by sulfurizing animal and vegetable fats or fatty oils such as beef tallow and soybean oil; unsaturated fatty acid such as oleic acid, linoleic acid, linolenic acid, or a fatty acid extracted from animal and vegetable fats or fatty oils; unsaturated fatty acid ester obtained by reacting these unsaturated fatty acids with various alcohols and acid chlorides; and mixtures thereof in an arbitrary method, and sulfurized olefins.

The content of the fire retardant promotor (D) is preferably 1.0 to 10.0 mass %, more preferably 1.0 to 8.0 mass %, and further preferably 2.0 to 7.0 mass % based on the total amount of the grease composition.

<Additive (E)>

The grease composition of the present embodiment may contain an additive (E) which can be selected from those blended in general greases.

Examples of such an additive include an antioxidant, a rust inhibitor, an extreme pressure agent, a thickener, a solid lubricant, a detergent dispersant, a corrosion inhibitor, and a metal deactivator, and one or more kinds thereof can be used.

Examples of the antioxidant include an amine-based antioxidant such as alkylated diphenylamine, phenyl-α-naphthylamine, and alkylated α-naphthylamine; and a phenol-based antioxidant such as 2,6-di-t-butyl-4-methylphenol and 4,4'-methylene bis(2,6-di-t-butylphenol).

Examples of the rust inhibitor include a sorbitan fatty acid ester and an amine compound.

Examples of the extreme pressure agent include a phosphorus-based compound and a sulfur and phosphorus based compound.

Examples of the thickener include polymethacrylate (PMA), an olefin copolymer (OCP), polyalkylstyrene (PAS), and a styrene-diene copolymer (SCP).

Examples of the solid lubricant include polyimide.

Examples of the detergent dispersant include an ashless dispersant such as succinimide and boron-based succinimide.

Examples of the corrosion inhibitor include a benzotriazole-based compound and a thiazole compound.

Examples of the metal deactivator include a benzotriazole-based compound.

The content of each additive in the grease composition is generally 0 to 10 mass %, preferably 0 to 7 mass %, more preferably 0 to 5 mass %, and more further preferably 0 to 2 mass % based on the total amount of the grease composition.

<Water Content>

In the present embodiment, a water content of the grease composition is preferably less than 1.0 mass %, more preferably less than 0.1 mass %, and further preferably less than 0.01 mass % based on the total amount of the grease composition.

By setting the water content of the grease composition to less than 1.0 mass %, it is possible to easily suppress rust from occurring on equipment and machines due to an influence of water. In addition, since the grease composition of the present embodiment uses the specific base oil and the specific fire retardant, it is possible to improve the fire extinguishing performance even without water.

<Sulfur Content>

In the present embodiment, the sulfur content of the grease composition is preferably less than 2.0 mass %, more preferably less than 1.0 mass %, and further preferably less than 0.5 mass % based on the total amount of the grease composition.

By setting the sulfur content of the grease composition to less than 2.0 mass %, malodor on burning can be easily suppressed.

The sulfur content of the grease composition can be measured according to ASTM D4951.

<Use of Grease Composition (Method of Using Grease Composition)>

The grease composition of the present embodiment can be used as the grease composition for various equipment and machines, and is particularly suitably used as the grease composition for steel manufacturing equipment, forging equipment, or a heat treatment apparatus in which fire extinguishing performance is important.

The heat treatment apparatus refers to an apparatus used for a heat treatment such as quenching, tempering, annealing, and normalizing.

[Method for Producing Grease Composition]

A method for producing the grease composition of the present embodiment includes the following steps (1) and (2):

(1) a step of mixing a base oil (A) containing a base oil (A1) having a 40° C. kinematic viscosity of 300 $mm^2/s$ or more, a sulfur content of 20 ppm by mass or less, and an initial boiling point of 400° C. or higher with a thickener (B) to thereby form a grease; and (2) a step of mixing the grease with at least one of aluminum hydroxide (C1) and 1,3,5-triazine-1,3,5 (2H, 4H, 6H)-tris (ethanol) (C2) as a fire retardant (C) after the step (1) to thereby obtain a grease composition in which a content of the fire retardant (C) is 1.0 to 12.5 mass % based on a total amount of the grease composition.

The thickener (B) may be synthesized during the step (1). For example, the thickener (B) may be obtained by adding a carboxylic acid and a metal hydroxide to the base oil (A), thereby causing saponification in the base oil (A).

In the step (1), the base oil (A) and the carboxylic acid are preferably heated and dissolved at 80° C. to 110° C. by stirring using a stirring blade or the like. After that, it is preferable to add a hydroxide and heat them to 150° C. to 200° C. to mix them. At this time, it is preferable to hold for 1 to 30 minutes.

The base oil (A) and the thickener (B) are mixed sufficiently, and subsequently the resulting mixture is preferably cooled to 120° C. to 160° C., and then cooled to 80° C. to 110° C. at 30° C. to 60° C./hour.

In the step (1), the above-described additive (E) may be further mixed.

In the step (2), it is preferable to sufficiently mix the composition obtained in the step (1) and the fire retardant (C) by stirring using a stirring blade or the like.

In the step (2), the above-described additive (E) may be mixed with the fire retardant (C).

EXAMPLES

Next, the present invention will be described in more detail by Examples, but the present invention is not limited at all by the Examples.

1. Measurement and Evaluation

Grease compositions of Examples and Comparative Examples and raw materials of these grease compositions were subjected to the following measurement and evaluation. The results are shown in Tables 1 and 2.

1-1. 40° C. Kinematic Viscosity, Viscosity Index, Sulfur Content, Initial Boiling Point, and Flash Point of Base Oil With respect to the base oils 1 to 3 used in Examples and Comparative Examples, the 40° C. kinematic viscosity and the viscosity index were measured according to JIS K2283: 2000, the sulfur content was measured according to a ultraviolet fluorescence method of JIS K2541-6, an initial boiling point was measured under a pressure of 133 Pa according to an reduced-pressure method of JIS K2254, and a flash point was measured according to a Cleveland open-cup method of JIS K2265-4: 2007.

1-2. Fire Extinguishing Performance, Fuming, Malodor, and Liquefaction

<Fire Extinguishing Performance>

70 g of the grease composition was put in a metal cylindrical vessel having a diameter of 16 cm and a height of 3 cm, and the surface was leveled evenly. A disc-shaped metal piece having a diameter of 5 cm and a thickness of 1 cm heated to 800° C. was placed on the surface leveled evenly to burn the grease composition. After 10 seconds, the metal piece was removed, and the time until the fire on the grease composition was completely extinguished after removing the metal piece was measured.

<Fuming>

The presence or absence of fuming was evaluated at the same time of burning the grease composition. The case where white smoke was observed was designated as "A", and the case where black smoke was observed was designated as "B".

<Malodor>

With respect to the grease compositions on which fire was completely extinguished, after the fire was extinguished, and with respect to the grease compositions on which fire was not extinguished, after they were allowed to be burned for 2 minutes after the metal piece was removed, and then the fire was forcibly extinguished, an extent of malodor was determined. Seven persons attended the test. The composition where five or more persons rated as no malodor was designated as "A", the composition where three and four persons rated as no malodor was designated as "B", and the composition where two persons or less rated as no malodor was designated as "C".

<Liquefaction>

With respect to the grease compositions on which fire was completely extinguished, after the fire was extinguished, and with respect to the grease compositions on which fire was not extinguished, after they were allowed to be burned for 2 minutes after the metal piece was removed, and then the file was forcibly extinguished, appearance and shape of the grease composition were evaluated visually. The grease composition whose shape was maintained without being liquefied was designated as "A", and the grease composition liquefied was designated as "C".

1-3. Lubricity (Shell Four-Ball Load Resistance Test)

A fusion load (WL value, unit N) was measured according to ASTM D2783-03 (2014) under conditions of a rotational speed of 1,760 rpm, 10 seconds, and room temperature. It can be said that the larger these values are, the better lubricity in a high load environment is. Those having a measurement value of 1,236 or more, less than 1,236 and 981 or more, and less than 981 were designated as A, B, and C, respectively.

1-4. Water Content

A water content of the grease composition was measured according to a Karl Fischer titration method of JIS K2275: 1996.

1-5. Sulfur Content

A sulfur atom content of the grease composition was measured according to ASTM D4951.

2. Raw Materials

Details of raw materials (base oil 1, base oil 2, base oil 3, aluminum hydroxide (C1), zinc carbonate (D1), and polyhydric alcohol (D2)) shown in Tables 1 and 2 and a step for preparing grease to be described later are as follows.

Base oil 1: A base oil obtained by distilling residual oil after normal pressure distillation of paraffinic crude oil under reduced pressure and dewaxing, deasphalting, and hydrofining the obtained reduced-pressure distillation residue oil. [Bright stock (A1-a), 40° C. kinematic viscosity: 408.8 $mm^2/s$, viscosity index: 107, sulfur content: 2 ppm by mass, initial boiling point: 465° C., flash point: 300° C.]

Base oil 2: A base oil obtained by distilling residual oil after normal pressure distillation of paraffinic crude oil under reduced pressure and dewaxing, deasphalting, and hydrofining the obtained reduced-pressure distilled oil. [500 N of mineral oil, 40° C. kinematic viscosity: 90.5 $mm^2/s$, viscosity index: 103, sulfur content: 3 ppm by mass, initial boiling point: 336° C., flash point: 250° C.]

Base oil 3: A base oil obtained by distilling residual oil after normal pressure distillation of paraffinic crude oil under reduced pressure and dewaxing, deasphalting, hydrofinishing, and solvent-extracting the obtained reduced-pressure distillation residue oil. [Bright stock (A1-b), 40° C. kinematic viscosity: 435.1 $mm^2/s$, viscosity index: 107, sulfur content: 10,200 ppm by mass, initial boiling point: 355° C., flash point: 330° C.]

Aluminum hydroxide (C1): manufactured by FUJIFILM Wako Pure Chemical Corporation, purity: 95%, average particle diameter: 1 μm 1,3,5-triazine-1,3,5 (2H, 4H, 6H)-tris(ethanol) (C2): manufactured by Maruzen Petrochemical Zinc carbonate (D1): Basic zinc carbonate, manufactured by FUJIFILM Wako Pure Chemical Corporation, purity: 69.0% to 74.0%

Polyhydric alcohol (D2): Glycerin, manufactured by FUJIFILM Wako Pure Chemical Corporation, purity: 97%

Calcium hydroxide: manufactured by FUJIFILM Wako Pure Chemical Corporation, purity: 96%

Magnesium hydroxide: manufactured by FUJIFILM Wako Pure Chemical Corporation, purity: 96%

3. Preparation of Lithium Complex Soap Grease and Lithium Soap Grease

Lithium complex soap greases 1 to 3 and lithium soap greases 1 to 2 serving as a base for the grease compositions of Examples 1 to 11 and Comparative Examples 1 to 9 were prepared.

3-1. Lithium Complex Soap Grease 1

(i) The base oil 1 (an amount of ½ of the amount described in Tables 1 and 2), 2.7 mass % of 12-hydroxy stearic acid, and 3.4 mass % of azelaic acid were charged into a grease producing kettle, and the mixture was heated and dissolved while stirring.

(ii) An aqueous solution in which 2.0 mass % of lithium hydroxide (monohydrate) was dissolved was added to the above (i). The mixture was heated and mixed until the temperature of the grease reached 192° C., and then held for 5 minutes.

(iii) The extreme pressure agent (zinc dialkyl dithiophosphate) was added and cooled to 140° C., then a remaining amount (an amount of ½ of the amount described in Tables 1 and 2) of the base oil 1 was added, placed in an environment of 50° C. for one hour and cooled to 100° C. to obtain a lithium complex soap grease 1.

3-2. Lithium Complex Soap Grease 2

A lithium complex soap grease 2 was obtained in the same manner as in the preparation of the lithium complex soap grease 1 except that the base oil 1 was changed to the base oil 2.

3-3. Lithium Complex Soap Grease 3

A lithium complex soap grease 3 was obtained in the same manner as in the preparation of the lithium complex soap grease 1 except that the base oil 1 was changed to the base oil 3.

3-4. Lithium Soap Grease 1

(i) The base oil 1 (an amount of ½ of the amount described in Table 1) and 5.8 mass % of 12-hydroxy stearic acid were charged into a grease producing kettle, and the mixture was heated and dissolved while stirring.

(ii) An aqueous solution in which 0.9 mass % of lithium hydroxide (monohydrate) was dissolved was added to the above (i), and the mixture was heated and mixed. When a temperature of grease reached 140° C., 0.3 mass % of zinc stearate was added, and the mixture was further heated and mixed. The temperature of grease reached 197° C., and then was held for 5 minutes.

(iii) Next, the remaining amount (an amount of ½ of the amount described in Table 1) of the base oil 1 was added, the mixture was placed in an environment of 50° C. for one hour and cooled to 80° C., and then an amine-based antioxidant was added and mixed therewith.

(iv) Further, the mixture was allowed to be naturally cooled to room temperature to obtain a lithium soap grease 1.

3-5. Lithium Soap Grease 2

A lithium soap grease 2 was obtained in the same manner as in the preparation of the lithium soap grease 1 except that the base oil 1 was changed to the base oil 2.

4. Preparation and Arrangement of Grease Composition

A fire retardant and a fire retardant promotor, and the like described in Tables 1 and 2 were added to the lithium complex soap grease or the lithium soap grease described in Tables 1 and 2, and a finishing treatment was performed using a three-roll apparatus to obtain each of the grease compositions of Examples 1 to 11 and Comparative Examples 1 to 9.

Further, a commercially available grease composition (manufactured by Kyodo Yushi, trade name: FR grease L No. 1, thickener: lithium soap, containing sulfur-based compound) was got as the grease composition of Comparative Example 10.

TABLE 1

| | | | Examples | | | | | |
|---|---|---|---|---|---|---|---|---|
| | | | 1 | 2 | 3 | 4 | 5 | 6 |
| Composition (mass %) | Lithium complex soap grease 1 | Base oil 1 [Base oil (A1)] | Remainder | Remainder | Remainder | Remainder | Remainder | Remainder |
| | | Lithium complex soap [Thickener (B)] | 6.7 | 6.7 | 6.7 | 6.7 | 6.7 | 6.7 |
| | | ZnDTP | 1.7 | 1.7 | 1.7 | 1.7 | 1.7 | 1.7 |
| | Lithium soap grease 1 | Base oil 1 [Base oil (A1)] | — | — | — | — | — | — |
| | | Lithium soap [Thickener (B)] | — | — | — | — | — | — |
| | | Amine-based antioxidant | — | — | — | — | — | — |
| | Fire retardant (C) | Aluminum hydroxide (C1) | 5.0 | 4.0 | 4.0 | 4.0 | — | 1.0 |
| | | 1,3,5-triazine-1,3,5 (2H, 4H, 6H)-tris(ethanol) (C2) | — | — | — | — | 4.0 | — |
| | Fire retardant promotor (D) | Zinc carbonate (D1) | — | — | — | 2.0 | 2.0 | — |
| | | Polyhydric alcohol (D2) | — | — | 3.0 | — | — | — |
| | Other additives | Calcium hydroxide | — | — | — | — | — | — |
| | | Magnesium hydroxide | — | — | — | — | — | — |
| Properties | Water content (mass %) | | 0.01> | 0.01> | 0.01> | 0.01> | 0.01> | 0.01> |
| | Sulfur content (mass %) | | 0.01> | 0.01> | 0.01> | 0.01> | 0.01> | 0.01> |
| Evaluation | Fire extinguishing performance (seconds) | | 12 | 20 | 7 | 9 | 31 | 25 |
| | Fuming | | A | A | A | A | A | A |
| | Malodor | | A | A | A | A | A | A |
| | Liquefaction | | A | A | A | A | A | A |
| | Lubricity (WL) | | A | A | A | A | A | A |

| | | | Examples | | | | |
|---|---|---|---|---|---|---|---|
| | | | 7 | 8 | 9 | 10 | 11 |
| Composition (mass %) | Lithium complex soap grease 1 | Base oil 1 [Base oil (A1)] | Remainder | Remainder | Remainder | Remainder | — |
| | | Lithium complex soap [Thickener (B)] | 6.7 | 6.7 | 6.7 | 6.7 | — |
| | | ZnDTP | 1.7 | 1.7 | 1.7 | 1.7 | — |
| | Lithium soap grease 1 | Base oil 1 [Base oil (A1)] | — | — | — | — | Remainder |
| | | Lithium soap [Thickener (B)] | — | — | — | — | 6.7 |
| | | Amine-based antioxidant | — | — | — | — | 1.7 |
| | Fire retardant (C) | Aluminum hydroxide (C1) | 10.0 | 3.0 | — | 3.0 | 5.0 |
| | | 1,3,5-triazine-1,3,5 (2H, 4H, 6H)-tris(ethanol) (C2) | — | 2.0 | 3.0 | 3.0 | — |
| | Fire retardant promotor (D) | Zinc carbonate (D1) | — | — | 3.0 | 3.0 | — |
| | | Polyhydric alcohol (D2) | — | — | — | 3.0 | — |
| | Other additives | Calcium hydroxide | — | — | — | — | — |
| | | Magnesium hydroxide | — | — | — | — | — |

TABLE 1-continued

| | | | | | | | |
|---|---|---|---|---|---|---|---|
| Properties | Water content (mass %) | 0.01> | 0.01> | 0.01> | 0.01> | 0.01> |
| | Sulfur content (mass %) | 0.01> | 0.01> | 0.01> | 0.01> | 0.01> |
| Evaluation | Fire extinguishing performance (seconds) | 10 | 18 | 32 | 15 | 10 |
| | Fuming | A | A | A | A | A |
| | Malodor | A | A | A | A | A |
| | Liquefaction | A | A | A | A | A |
| | Lubricity (WL) | A | A | A | A | A |

TABLE 2

| | | | Comparative Examples | | | | | |
|---|---|---|---|---|---|---|---|---|
| | | | 1 | 2 | 3 | 4 | 5 | 6 |
| Composition (mass %) | Lithium complex soap grease 1 | Base oil 1 [Base oil (A1)] | Remainder | Remainder | Remainder | Remainder | Remainder | — |
| | | Lithium complex soap [Thickener (B)] | 6.7 | 6.7 | 6.7 | 6.7 | 6.7 | — |
| | | ZnDTP | 1.7 | 1.7 | 1.7 | 1.7 | 1.7 | — |
| | Lithium complex soap grease 2 | Base oil 2 | — | — | — | — | — | Remainder |
| | | Lithium complex soap [Thickener (B)] | — | — | — | — | — | 6.7 |
| | | ZnDTP | — | — | — | — | — | 1.7 |
| | Lithium complex soap grease 3 | Base oil 3 | — | — | — | — | — | — |
| | | Lithium complex soap [Thickener (B)] | — | — | — | — | — | — |
| | | ZnDTP | — | — | — | — | — | — |
| | Lithium soap grease 2 | Base oil 2 | — | — | — | — | — | — |
| | | Lithium soap [Thickener (B)] | — | — | — | — | — | — |
| | | Amine-based antioxidant | — | — | — | — | — | — |
| | Fire retardant (C) | Aluminum hydroxide | 0.5 | 15.0 | — | — | — | 5.0 |
| | | 1,3,5-triazine-1,3,5 (2H, 4H, 6H)-tris(ethanol) (C2) | — | — | — | — | — | — |
| | Fire retardant promotor (D) | Zinc carbonate (D1) | — | — | — | — | 3.0 | — |
| | | Polyhydric alcohol (D2) | — | — | — | — | — | — |
| | Other additives | Calcium hydroxide | — | — | 5.0 | — | — | — |
| | | Magnesium hydroxide | — | — | — | 5.0 | — | — |
| Properties | Water content (mass %) | | 0.01> | 0.01> | 0.01> | 0.01> | 0.01> | 0.01> |
| | Sulfur content (mass %) | | 0.01> | 0.01> | 0.01> | 0.01> | 0.01> | 0.01> |
| Evaluation | Fire extinguishing performance (seconds) | | Not extinguished | 12 | 35 | Not extinguished | 40 | Not extinguished |
| | Fuming | | A | A | A | A | A | A |
| | Malodor | | A | A | A | A | A | A |
| | Liquefaction | | A | A | A | A | A | A |
| | Lubricity (WL) | | A | C | B | B | A | B |

| | | | Comparative Examples | | | |
|---|---|---|---|---|---|---|
| | | | 7 | 8 | 9 | 10 |
| Composition (mass %) | Lithium complex soap grease 1 | Base oil 1 [Base oil (A1)] | — | Remainder | — | Commercially available product |
| | | Lithium complex soap [Thickener (B)] | — | 6.7 | — | |
| | | ZnDTP | — | 1.7 | — | |
| | Lithium complex soap grease 2 | Base oil 2 | — | — | — | |
| | | Lithium complex soap [Thickener (B)] | — | — | — | |
| | | ZnDTP | — | — | — | |
| | Lithium complex soap grease 3 | Base oil 3 | — | — | Remainder | |
| | | Lithium complex soap [Thickener (B)] | — | — | 6.7 | |
| | | ZnDTP | — | — | 1.7 | |
| | Lithium soap grease 2 | Base oil 2 | Remainder | — | — | |
| | | Lithium soap [Thickener (B)] | 6.7 | — | — | |
| | | Amine-based antioxidant | 1.0 | — | — | |
| | Fire retardant (C) | Aluminum hydroxide | 5.0 | — | 5.0 | |
| | | 1,3,5-triazine-1,3,5 (2H, 4H, 6H)-tris(ethanol) (C2) | — | 15.0 | — | |
| | Fire retardant promotor (D) | Zinc carbonate (D1) | — | — | — | |
| | | Polyhydric alcohol (D2) | — | — | — | |
| | Other additives | Calcium hydroxide | — | — | — | |
| | | Magnesium hydroxide | — | — | — | |
| Properties | Water content (mass %) | | 0.01> | 0.01> | 0.01> | 0.01> |
| | Sulfur content (mass %) | | 0.01> | 0.01> | 1.0 | 1.5 |
| Evaluation | Fire extinguishing performance (seconds) | | Not extinguished | 40 | 23 | 32 |
| | Fuming | | B | A | A | B |
| | Malodor | | A | C | B | C |

TABLE 2-continued

| | | | | |
|---|---|---|---|---|
| Liquefaction | A | A | A | C |
| Lubricity (WL) | B | B | A | B |

From the results of Tables 1 and 2, the grease compositions of Examples 1 to 11 are excellent in fire extinguishing performance while water is not contained. Further, it can be confirmed that fuming, malodor, and liquefaction on burning can be suppressed and the lubricity is also good.

On the other hand, the grease compositions of Comparative Examples 1 and 3 to 5 have a small content of a fire retardant or contain no fire retardant, and therefore, the fire extinguishing performance is insufficient, and the flame retardancy is poor. In the grease compositions of Comparative Examples 2 and 8, the content of the fire retardant is large, and therefore, they have an insufficient lubricity or cause malodor. In each of the grease compositions of Comparative Examples 6 and 7, an initial boiling point of the base oil is low, and therefore, the fire extinguishing time is long, and the fire extinguishing performance is poor. In the grease composition of Comparative Example 9, the sulfur content of the base oil is large, so that malodor occurs at the time of burning. Further, in the grease composition of Comparative Example 9, the initial boiling point of the base oil is low, and therefore, the fire extinguishing time is long, and the fire extinguishing performance is poor as compared with the grease composition of Example 1 in which the kind and addition amount of the fire retardant are the same.

INDUSTRIAL APPLICABILITY

The grease composition of the present embodiment is excellent in fire extinguishing performance without water and can suppress fuming, malodor, and liquefaction on burning. Therefore, the grease composition of the present embodiment can be suitably used in various equipment and machines, particularly suitably used as the grease composition for steel manufacturing equipment, forging equipment, or a heat treatment apparatus in which fire extinguishing performance is important.

The invention claimed is:

1. A grease composition comprising:

a base oil (A), a thickener (B), and a fire retardant (C), wherein the base oil (A) comprises a base oil (A1) having a 40° C. kinematic viscosity of 300 $mm^2/s$ or more, a sulfur content of 20 ppm by mass or less, and an initial boiling point of 400° C. or higher, the fire retardant (C) comprises aluminum hydroxide (C1), 1,3,5-triazine-1,3,5 (2H, 4H, 6H)-tris(ethanol) (C2), or a combination thereof, a content of the fire retardant (C) is from 1.0 to 12.0 mass % based on a total amount of the grease composition, and a water content of the grease composition is less than 1.0 mass % based on the total amount of the grease composition.

2. The grease composition according to claim 1, wherein a content of the base oil (A1) is 80 mass % or more based on a total amount of the base oil (A).

3. The grease composition according to claim 2, wherein the base oil (A1) has a 40° C. kinematic viscosity of from 300 to 1,000 $mm^2/s$.

4. The grease composition according to claim 1, wherein the base oil (A1) is a bright stock.

5. The grease composition according to claim 1, wherein the thickener (B) is a soap-based thickener.

6. The grease composition according to claim 1, wherein the aluminum hydroxide (C1) has an average particle diameter of 5.0 μm or less.

7. The grease composition according to claim 1, further comprising at least one retardant promotor (D) selected from the group consisting of zinc carbonate (D1), polyhydric alcohol (D2), and sulfurized fats or fatty oils (D3).

8. The grease composition according to claim 1, wherein the sulfur content of the grease composition is less than 2.0 mass % based on the total amount of the grease composition.

9. A grease composition for steel manufacturing equipment, forging equipment, or a heat treatment apparatus, comprising the grease composition according to claim 1.

10. A method for producing a grease composition, comprising:

mixing a base oil (A) comprising a base oil (A1) having a 40° C. kinematic viscosity of 300 $mm^2/s$ or more, a sulfur content of 20 ppm by mass or less, and an initial boiling point of 400° C. or higher, with a thickener (B) to form a grease; and mixing the grease with aluminum hydroxide (C1), 1,3,5-triazine-1,3,5 (2H, 4H, 6H)-tris(ethanol) (C2), or a combination thereof, as a fire retardant (C), after the mixing the base oil (A) and the thickener (B), to obtain a grease composition in which a content of the fire retardant (C) is from 1.0 to 12.0 mass % based on a total amount of the grease composition, wherein a water content of the grease composition is less than 1.0 mass % based on the total amount of the grease composition.

11. A process, comprising applying the grease composition of claim 1 as a grease composition in lubricating steel manufacturing equipment, a forging equipment, or a heat treatment apparatus.

12. The grease composition according to claim 1, wherein the content of the fire retardant (C) is from 1.0 to 10.0 mass % based on a total amount of the grease composition.

* * * * *